US007273189B2

(12) United States Patent
Ide et al.

(10) Patent No.: US 7,273,189 B2
(45) Date of Patent: Sep. 25, 2007

(54) PROTECTIVE COVER FOR FRANGIBLE BULB

(75) Inventors: Stephen R. Ide, Easton, PA (US); Richard D. Schilling, Breinigsville, PA (US)

(73) Assignee: Victaulic Company, Easton, PA (US)

( * ) Notice: Subject to any disclaimer, the term of this patent is extended or adjusted under 35 U.S.C. 154(b) by 832 days.

(21) Appl. No.: 10/641,546

(22) Filed: Aug. 15, 2003

(65) Prior Publication Data

US 2005/0035022 A1 Feb. 17, 2005

(51) Int. Cl.
*B05B 1/28* (2006.01)

(52) U.S. Cl. ..... 239/288; 206/418; 220/724; 169/37

(58) Field of Classification Search ..... 206/418, 206/528; 220/724, 4.23, 4.24, 4.25; 239/288, 239/288.3, 288.5
See application file for complete search history.

(56) References Cited

U.S. PATENT DOCUMENTS

| | | | | | |
|---|---|---|---|---|---|
| 432,403 | A | | 7/1890 | Grinnel | 169/39 |
| D26,255 | S | | 11/1896 | Esty | D23/214 |
| D184,373 | S | | 2/1959 | Rider | D23/214 |
| D210,457 | S | | 3/1968 | Mease | D23/214 |
| 3,388,747 | A | | 6/1968 | Hodnett | 169/39 |
| 3,801,014 | A | | 4/1974 | Cantales | 239/104 |
| 3,971,443 | A | | 7/1976 | Zenker | 169/39 |
| 4,049,357 | A | * | 9/1977 | Hamisch, Jr. | 403/209 |
| 5,097,906 | A | | 3/1992 | Polan | 169/37 |
| 5,234,059 | A | | 8/1993 | Eynon | 169/39 |
| 5,447,338 | A | | 9/1995 | Kikuchi | 285/46 |
| 5,570,745 | A | | 11/1996 | MacDonald, III | 169/16 |
| 5,632,339 | A | | 5/1997 | Fenske et al. | 169/37 |
| 5,743,337 | A | | 4/1998 | MacDonald, III | 169/16 |
| 5,806,555 | A | * | 9/1998 | Magno, Jr. | 137/385 |
| 5,893,418 | A | | 4/1999 | Ponte | 169/37 |
| 6,098,256 | A | * | 8/2000 | Poussard | 24/704.1 |
| 6,131,822 | A | | 10/2000 | Farmer, Jr. | 239/288 |
| 6,206,033 | B1 | * | 3/2001 | Chang | 137/551 |
| 6,335,672 | B1 | * | 1/2002 | Tumlin et al. | 336/175 |
| 2003/0173094 | A1 | | 9/2003 | Vinson et al. | 169/37 |

OTHER PUBLICATIONS

Design U.S. Appl. No. 29/188,857, filed Aug. 25, 2003, entitled Bulb Cover (Ide et al).

Design U.S. Appl. No. 29/208,543, filed Jun. 30, 2004, entitled Bulb Cover (Ide et al).

U.S. Patent Appl., filed Mar. 14, 2002, entitled *Protector for Thermally Responsive Member of Sprinkler* Head (Vinson et al).

* cited by examiner

*Primary Examiner*—Mickey Yu
*Assistant Examiner*—Steven Pollicoff
(74) *Attorney, Agent, or Firm*—Synnestvedt & Lechner LLP

(57) ABSTRACT

A cover mountable on a support frame for protecting a frangible item mounted within the frame is disclosed. The cover has first and second cover portions engaging the frame on opposite sides of the item. A hinge connects first ends of the covers together and a releasable fastener connects the other ends. Fingers extend from one or both of the cover portions toward the opposite cover portion and are positioned in spaced relation to the ends of the cover portions. The fingers and the ends of the cover portions define spaces at opposite ends of the cover which receive and engage portions of the support frame. The fingers are in spaced relation to one another and define a space between them for receiving the frangible item. The fingers are sized and spaced so that they transfer any force on the cover to the frame exclusively. The covers have an arcuate shape to provide increased stiffness.

27 Claims, 2 Drawing Sheets

FIG.1
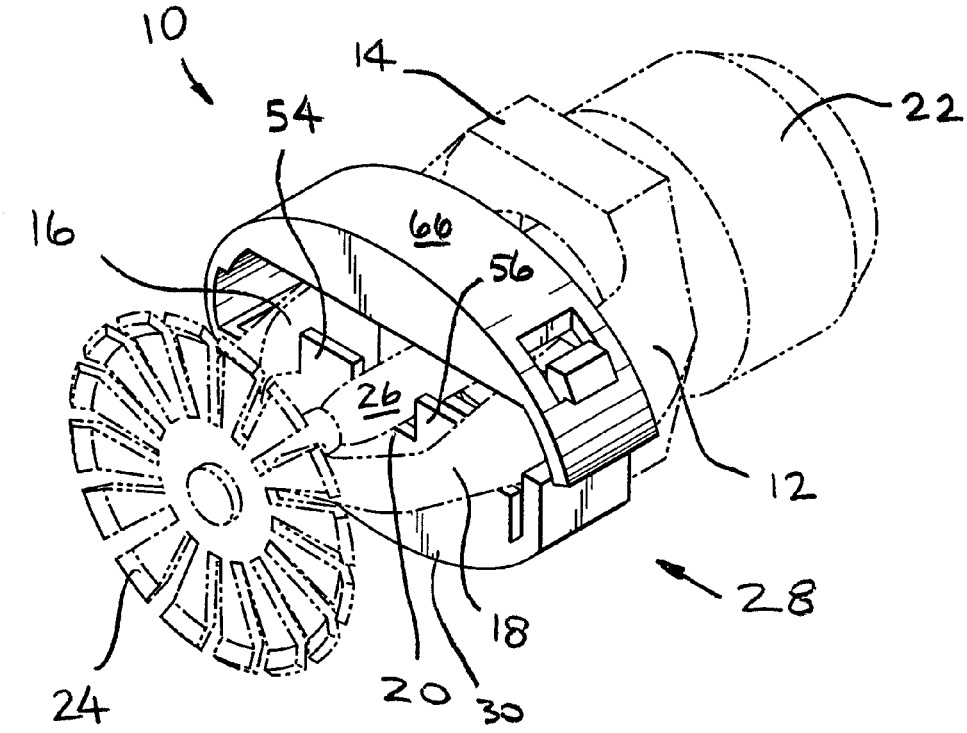
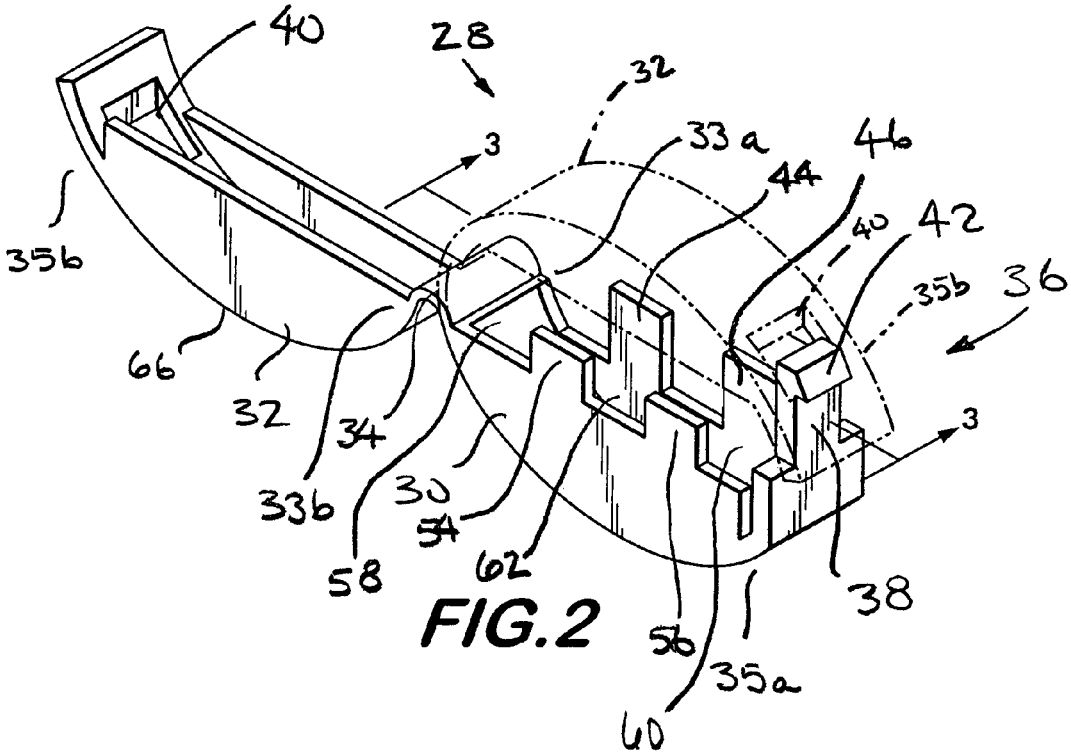
FIG.2

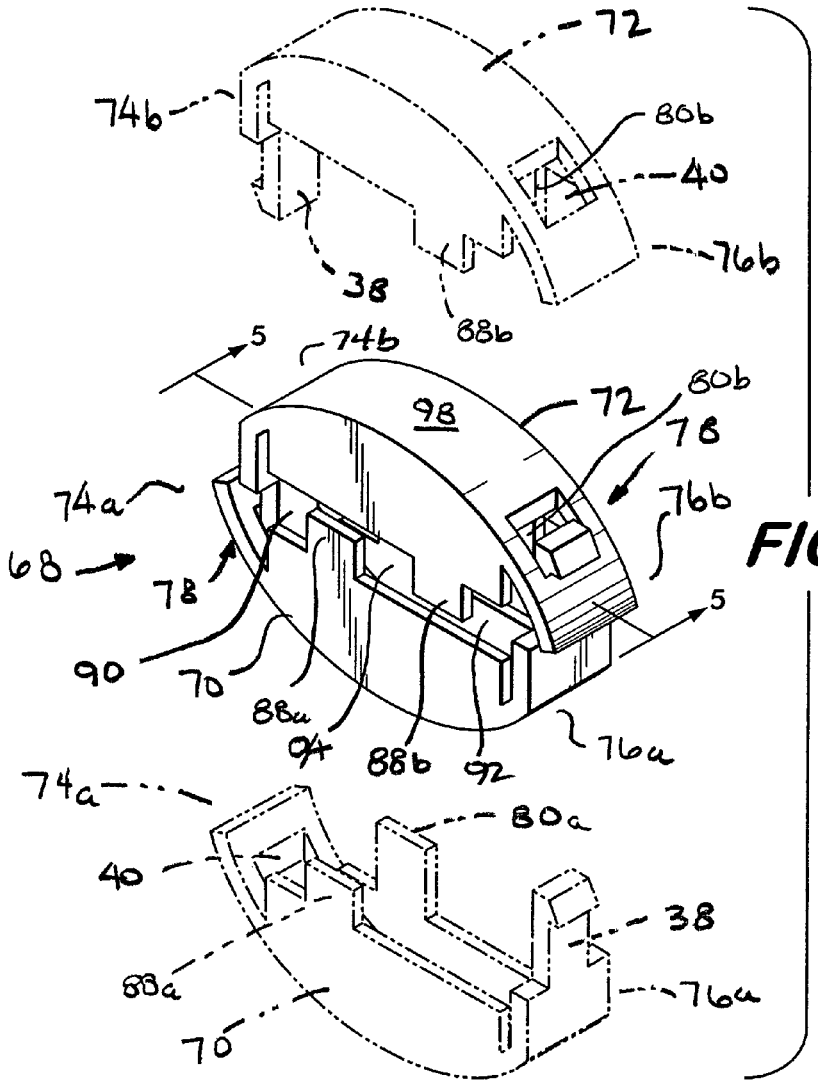
FIG.4
FIG.3
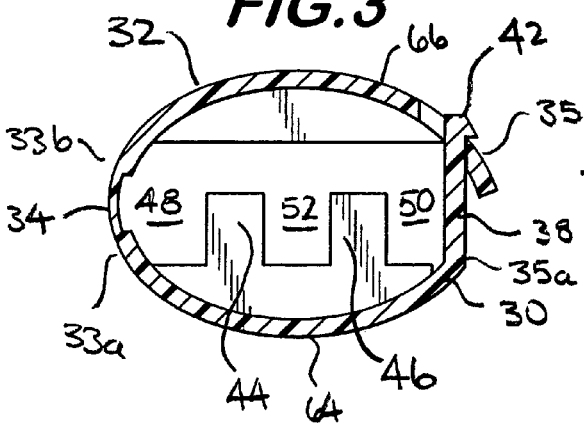
FIG.5
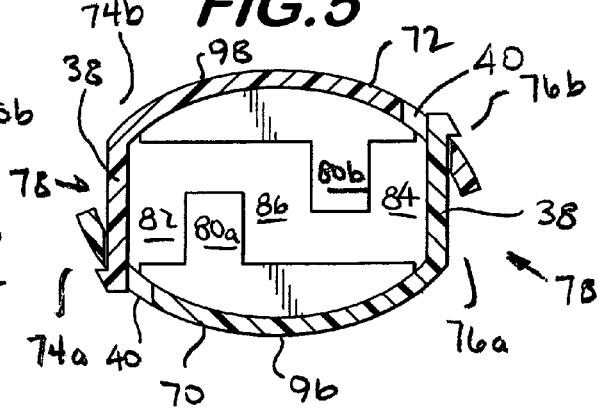

PROTECTIVE COVER FOR FRANGIBLE BULB

FIELD OF THE INVENTION

This invention relates to a device for protecting frangible items, and especially to frangible glass bulbs used in sprinkler heads of fire suppression systems.

BACKGROUND OF THE INVENTION

Fire suppression systems are used extensively in office buildings, warehouses, factories, hotels, homes and other buildings and structures to provide a reliable and effective means to suppress the spread of fire throughout the building or structure. Such systems may comprise a piping network extending throughout the building. The piping network is connected to a source of fire suppressing fluid, for example, water, and is in fluid communication with sprinkler heads distributed throughout the building which will discharge the fire suppressing fluid in the event of a fire.

Each sprinkler head has a valve which is biased into a normally open position, but is held in a closed position against the biasing force by a frangible glass bulb that contains a heat-sensitive fluid. The bulb is elongate in design and the biasing force places it under compression along its long axis. The bulb is very strong in compression along its long axis but easily breaks when force is applied transverse to this axis. During a fire, the heat-sensitive fluid expands within the bulb and when a predetermined temperature is reached the heat-sensitive fluid applies hydraulic pressure outwardly against the bulb normal to the long axis, causing the bulb to shatter, and thereby allow the valve to open and discharge the fire suppressing fluid.

The bulb is designed to break at the predetermined temperature, and when installed properly is very reliable. However, the bulb must be frangible to operate effectively and is typically made of glass which is susceptible to damage. Damage which can compromise the performance of the bulb may be caused during packing, shipping or installation of the sprinkler head and may comprise a scratch or nick in the bulb caused by a tool or another sprinkler head, as well as a crack or a small hole which allows the heat-sensitive fluid to escape. If such damage is not prevented or at least mitigated, then it is possible that the bulb may fail prematurely at a temperature lower than the predetermined temperature, thus, triggering discharge from the sprinkler head in the absence of a fire condition. This may result in extensive water damage to the building and its contents. More seriously, the damage may prevent the sprinkler head from discharging at all, as may happen if the heat-sensitive fluid is permitted to leak out. This condition will compromise the fire safety of the building and should be avoided. It is, therefore, desirable to protect such frangible items during handling, packing, shipping and installation of the sprinkler heads to ensure that they function properly when the fire suppression system is brought on line.

SUMMARY OF THE INVENTION

The invention concerns a cover for protecting a frangible item mounted within a support frame such as a glass bulb used with a sprinkler head in a fire suppression system. The cover comprises a first cover portion positionable adjacent to the frangible item and having a first end. A second cover portion is also positionable adjacent to the frangible item but opposite to the first cover portion. The second cover portion has a second end, the first and second ends of the cover portions being attached to one another. A first finger projects from the first cover portion toward the second cover portion and is positioned in spaced relation to the first and second ends. A first space is defined between the first finger and the first and second ends for receiving a portion of the support frame, the first finger and the first and second ends of the cover portions engage the support frame for positioning the cover thereon adjacent to the frangible item.

The cover may also comprise a first opposite end positioned on the first cover portion opposite the first end and a second opposite end positioned on the second cover portion opposite the second end. A second finger projects from one of the first and second cover portions toward the other of the first and second cover portions. The second finger is positioned in spaced relation to the first and second opposite ends. A second space is defined between the second finger and the first and second opposite ends for receiving another portion of the support frame. The second finger and the first and second opposite ends of the cover portions engage the support frame for positioning the cover thereon adjacent to the frangible item.

Another embodiment of a cover for protecting a frangible item mounted within a support frame comprises a pair of interengageable cover portions positionable on opposite sides of the frangible item. Each of the cover portions comprises a first end having a latch extending therefrom, a second end having a slot therein and a first finger positioned in spaced relation to one of the first and the second ends. The first finger extends in substantially the same direction as the latch. The cover portions are positionable in engagement one with another by aligning the cover portions and inserting the latches on each one of the cover portions into the slots on each other of the cover portions. A first and a second space are defined between the first fingers and the first and second ends of the cover portions upon their engagement. Each of the spaces receives a respective portion of the support frame. The first fingers and the ends of the cover portions engage the portions of the support frame for positioning the cover thereon adjacent to the frangible item.

BRIEF DESCRIPTION OF THE DRAWINGS

FIG. 1 is a perspective view of a cover according to the invention installed on a sprinkler head, the sprinkler head shown in phantom line;

FIG. 2 is a perspective view of the cover shown in FIG. 1 in an open position, shown in solid line, and a closed position, shown in phantom line;

FIG. 3 is a cross-sectional view taken at line 3-3 of FIG. 2;

FIG. 4 is a perspective view of another embodiment of the cover according to the invention, an exploded view being shown in phantom line; and FIG. 5 is a cross-sectional view taken at line 5-5 of FIG. 4.

DETAILED DESCRIPTION OF THE EMBODIMENTS

FIG. 1 depicts an example of a sprinkler head 10, shown in phantom line, used with a fire suppression system to spray a fire suppressing fluid onto a fire. Sprinkler head 10 includes a support frame 12 having a collar 14 from which extend two limbs 16 and 18. Limbs 16 and 18 are positioned in spaced relation to one another to define an open space 20 between them. A valve 22 is attached to collar 14 for controlling the flow of fire suppressing fluid onto the fire. A deflector plate 24 is attached to the ends of limbs 16 and 18 in the path of the fluid flow from valve 22 to deflect and thereby distribute the fluid discharged from the valve over a desired area. A frangible glass bulb 26 is mounted in space 20 between the ends of the limbs 16 and 18 and the valve 22. Bulb 26 is elongate and, when present, engages the moving member of the valve to keep it in a closed position against a biasing force, usually provided by a spring within the valve (not shown), which normally biases the valve into an open position to permit fluid flow. A heat-sensitive fluid within the bulb expands when heated, and when a predetermined temperature is reached, the internal hydraulic pressure within the bulb breaks it. The bulb collapses, no longer able to restrain the biasing force and the valve opens to allow water to discharge.

A cover 28, shown in solid line, is removably mounted on the support frame 12 surrounding and protecting the glass bulb 26 exposed in the open space 20 between limbs 16 and 18. As shown in FIG. 2, cover 28 comprises first and second cover portions 30 and 32 respectively, joined together at their respective ends 33*a* and 33*b* by a hinge 34. Cover portions 30 and 32 are pivotable about hinge 34 to facilitate their placement adjacent to bulb 26 and engagement with support frame 12 as illustrated in FIG. 1. Hinge 34 is preferably a flexible "living hinge" made of a thin section of relatively flexible material allowing the cover portions to be pivoted-repeatedly without fatigue failure. Other forms of hinges are also feasible, such as piano hinges, socket and trunnion hinges and the like. Preferably, hinge 34 is resilient and provides a biasing force which tends to hold the cover portions 30 and 32 in a closed position shown in phantom line in FIG. 2.

A fastener 36 may be positioned between the respective ends 35*a* and 35*b* of cover portions 30 and 32 opposite the hinge 34. Fastener 36 releasably attaches ends 35*a* and 35*b* to one another, and preferably comprises a latch 38 extending from one cover portion (in this example cover portion 30) and a slot 40 in the other cover portion (32) sized and aligned to receive the latch 38. Latch 38 is cantilevered from the cover portion 30 and has a barbed end 42 which engages the slot 40 and prevents inadvertent removal of the latch 38 from the slot 40. However, latch 38 is flexible and resilient and may be manually deformed so that the barbed end 42 disengages from slot 40 to allow the cover portions 30 and 32 to be pivoted about hinge 34 into the open position shown in solid line in FIG. 2 for removal of the cover 28 from or attachment to the sprinkler head 10. Other types fasteners could also be used, such as nuts and bolts, hook and loop systems and the like to relesably secure the cover portions 30 and 32 one to the other.

As shown in FIG. 3, first and second fingers 44 and 46 respectively, are arranged in spaced relation to one another and project from first cover portion 30 toward second cover portion 32. Finger 44 is positioned in spaced relation to ends 33*a* and 33*b* of the cover portions. The ends 33*a* and 33*b* and finger 44 define a space 48 between them for receiving the limb 16 of support frame 12 when the cover 28 is positioned on the sprinkler head as shown in FIG. 1. Similarly, finger 46 is positioned in spaced relation to ends 35*a* and 35*b* of the cover portions. The ends 35*a* and 35*b* and finger 46 define a space 50 between them for receiving the limb 18 of support frame 12 when the cover 28 is positioned on the sprinkler head as shown in FIG. 1. Although fingers 44 and 46 are shown in FIG. 3 extending from first cover portion 30, it is understood that they could also be positioned on second cover portion 32 or on both cover portions. Fingers 44 and 46 also define a center space 52 which receives the glass bulb 26. Preferably, fingers 44 and 46 are sized and spaced relative to respective ends 33*a*, 33*b* and 35*a*, 35*b* so that the ends and the fingers will engage the limbs 16 and 18, hold the cover 28 securely on the support frame 12 and transfer any impact force on the cover 28 exclusively to the frame 12. To that end, fingers 44 and 46 are further sized so that they flank bulb 26 without contacting it, thereby preventing any side loads from impinging on the bulb when the cover is bumped during handling, packing, shipping or installation of the sprinkler head 10.

As shown in FIG. 2, cover 28 may also have additional fingers 54 and 56 offset from fingers 44 and 46. Fingers 54 and 56 again extend, in this example, from the first cover portion 30 toward the second cover portion 32, although other variations of finger placement are feasible as described above for fingers 44 and 46. Finger 54 is positioned in spaced relation to ends 33*a* and 33*b* of the cover portions. The ends 33*a* and 33*b* and finger 54 define a space 58 between them for receiving the limb 16 of support frame 12 when the cover 28 is positioned on the sprinkler head as shown in FIG. 1. Similarly, finger 56 is positioned in spaced relation to ends 35*a* and 35*b* of the cover portions. The ends 35*a* and 35*b* and finger 56 define a space 60 between them for receiving the limb 18 of support frame 12 when the cover 28 is positioned on the sprinkler head as shown in FIG. 1. Fingers 54 and 56 also define a center space 62 which receives the glass bulb 26. Similar to fingers 44 and 46, fingers 54 and 56 are sized and spaced relative to respective ends 33*a*, 33*b* and 35*a*, 35*b* so that the ends and the fingers will engage the limbs 16 and 18, hold the cover 28 securely on the support frame 12 and transfer any impact force on the cover 28 exclusively to the frame 12. Fingers 54 and 56 are also sized so that they flank bulb 26 without contacting it, thereby preventing any side loads from impinging on the bulb when the cover is bumped during handling, packing, shipping or installation of the sprinkler head 10.

Preferably, space 58 is substantially aligned with space 48, space 60 is substantially aligned with space 50 and space 62 is substantially aligned with space 52. The fingers may have different lengths to accommodate any variation in dimensions of the limbs 16 and 18.

Preferably, as shown in FIG. 3, the cover portions 30 and 32 have outwardly facing surfaces 64 and 66 that are arcuate in shape. This increases the stiffness of the cover 28 and thus reduces the magnitude of cover deflection when forces impinge on it to provide additional protection to the bulb 26.

FIG. 4 shows another embodiment 68 of a cover according to the invention. Cover 68 comprises two separate cover portions 70 and 72 which are attached to one another at their respective ends 74*a*, 74*b* and 76*a*, 76*b* by fasteners 78. Preferably, the fasteners 78 comprise latches 38 and receiving slots 40 as described above because they facilitate rapid manual engagement and disengagement of the cover portions 70 and 72. Other types fasteners could also be used however, such as nuts and bolts, hook and loop systems and the like.

Preferably, cover portion 72 is a mirror image of cover portion 70, each having a latch 38 at one end, a slot 40 at an opposite end, and a finger identified as 80*a* or 80*b*, which extends toward the opposite cover portion when the cover 68 is mounted on the support frame 12. Such a configuration allows each cover portion 70 and 72 to be substantially identical to one another, thus saving on capital costs, such as molds, associated with manufacture.

As best shown in FIG. 5, finger 80*a* extends from cover portion 70 and is positioned in spaced relation to the ends

74*a* and 74*b* of the cover portions 70 and 72. Together finger 80*a* and ends 74*a* and 74*b* define a space 82 for receiving limb 16 of support frame 12. Similarly, finger 80*b* and ends 76*a* and 76*b* of cover portions 70 and 72 define a space 84 for receiving limb 18 of support frame 12. Fingers 80*a* and 80*b* are positioned in spaced relation to one another and also define a center space 86 which receives the glass bulb 26 when the cover portions 70 and 72 are positioned on the support frame 12. Preferably, fingers 80*a* and 80*b* are sized and spaced relative to respective ends 74*a*, 74*b* and 76*a*, 76*b* so that the ends and the fingers will engage the limbs 16 and 18, hold the cover 28 securely on the support frame 12 and transfer any impact force on the cover 28 exclusively to the frame 12. To that end, fingers 80*a* and 80*b* are further sized so that they flank bulb 26 without contacting it, thereby preventing any side loads from impinging on the bulb when the cover is bumped during handling, packing, shipping or installation of the sprinkler head 10.

As shown in FIG. 4, cover 68 may also have additional fingers 88*a* and 88*b* offset from fingers 80*a* and 80*b*. Fingers 88*a* and 88*b* again extend, in this example, respectively from each cover portion 70 and 72, although other variations of finger placement are feasible. Finger 88*a* is positioned in spaced relation to ends 74*a* and 74*b* of the cover portions. The ends 74*a* and 74*b* and finger 88*a* define a space 90 between them for receiving the limb 16 of support frame 12 when the cover 68 is positioned on the sprinkler head. Similarly, finger 88*b* is positioned in spaced relation to ends 76*a* and 76*b* of the cover portions. The ends 76*a* and 76*b* and finger 88*b* define a space 92 between them for receiving the limb 18 of support frame 12 when the cover 68 is positioned on the sprinkler head. Fingers 88*a* and 88*b* also define a center space 94 which receives the glass bulb 26. Similar to fingers 80*a* and 80*b*, fingers 88*a* and 88*b* are sized and spaced relative to respective ends 74*a*, 74*b* and 76*a*, 76*b* so that the ends and the fingers will engage the limbs 16 and 18, hold the cover 28 securely on the support frame 12 and transfer any impact force on the cover 68 exclusively to the frame 12. Fingers 88*a* and 88*b* are also sized so that they flank bulb 26 without contacting it, thereby preventing any side loads from impinging on the bulb when the cover is bumped during handling, packing, shipping or installation of the sprinkler head 10.

Preferably, space 90 is substantially aligned with space 82, space 92 is substantially aligned with space 84 and space 94 is substantially aligned with space 86. The fingers may have different lengths to accommodate any variation in dimensions of the limbs 16 and 18.

Again, as best shown in FIG. 5, the cover portions 70 and 72 have respective arcuate outer surfaces 96 and 98 to increase stiffness of the cover 68 and reduce cover deflection to provide additional protection to the bulb 26.

Covers according to the invention are preferably made of polymers such as polypropylene, polyethylene, and nylon in an injection molding process. These plastics are preferred because they result in a tough, resilient cover which maintains its flexibility and structural integrity over a wide temperature range.

Use of covers as described herein will provide increased protection to frangible bulbs used in sprinkler heads thus providing a greater degree of fire safety by increasing the likelihood that properly functioning sprinkler heads are installed in fire suppression systems. The covers will also help reduce costs as fewer bulbs will be damaged during handling, packing, shipping and installation and require replacement.

What is claimed is:

1. In combination, a cover and a sprinkler head, said sprinkler head comprising a frangible item mounted within a support frame, said cover comprising:

a first cover portion positionable adjacent to said frangible item and having a first end;

a second cover portion positionable adjacent to said frangible item opposite to said first cover portion and having a second end, said first and second ends being attached to one another, said first cover portion comprising an arcuate surface having a convex side facing away from said second cover portion;

a first finger projecting from said first cover portion toward said second cover portion and positioned in spaced relation to said first and second ends; and a first space being defined between said first finger and said first and second ends for receiving a portion of said support frame, said first finger and said first and second ends of said cover portions engaging said support frame for positioning said cover thereon adjacent to said frangible item.

2. The combination according to claim 1, further comprising:

a first opposite end positioned on said first cover portion opposite said first end;

a second opposite end positioned on said second cover portion opposite said second end;

a second finger projecting from one of said first and second cover portions toward the other of said first and second cover portions, said second finger being positioned in spaced relation to said first and second opposite ends; and a second space being defined between said second finger and said first and second opposite ends for receiving another portion of said support frame, said second finger and said first and second opposite ends of said cover portions engaging said support frame for positioning said cover thereon adjacent to said frangible item.

3. The combination according to claim 1, wherein said second cover portion comprises an arcuate surface having a convex side facing away from said first cover portion.

4. The combination according to claim 1, further comprising a hinge positioned between said first and second ends and attaching said ends together, said cover portions being pivotable relatively to one another about said hinge.

5. The combination according to claim 4, wherein said hinge comprises a living hinge formed of a flexible, resilient material, said living hinge being biased to maintain said cover portions in facing relation opposite to one another.

6. The combination according to claim 4, further comprising:

a first opposite end positioned on said first cover portion opposite said first end;

a second opposite end positioned on said second cover portion opposite said second end; and a fastener extending between said first and said second opposite ends for releasably attaching said first and said second cover portions together.

7. The combination according to claim 6, wherein said fastener comprises:

a latch extending from one of said first and second opposite ends toward the other of said first and second opposite ends; and a slot positioned within the other of said first and second opposite ends, said latch being engageable within said slot to releasably attach said first and second opposite ends together.

8. The combination according to claim 2, further comprising:

a first latch extending from said first end toward said second end;

a first slot positioned within said second end for receiving said first latch;

a second latch extending from one of said first and said second opposite ends toward the other of said first and said second opposite ends; and a second slot positioned within the other of said first and said second opposite ends for receiving said second latch, said first and second cover portions being releasably attachable to one another upon engagement of said latches with said slots.

9. The combination according to claim 8, wherein said second finger extends from said second cover portion.

10. The combination according to claim 8, wherein said second latch extends from said second opposite end and said second slot is positioned within said first opposite end.

11. The combination according to claim 1, further comprising:

a third finger projecting from one of said first and second cover portions toward the other of said first and second cover portions, said third finger being positioned in spaced relation to said first and second ends; and a third space being defined between said third finger and said first and second ends, said third space being substantially aligned with said first space for receiving said portion of said support frame, said third finger and said first and second ends of said cover portions engaging said supporting frame for positioning said cover thereon adjacent to said frangible item.

12. The combination according to claim 2, further comprising:

a third finger projecting from said first cover portion toward said second cover portion, said third finger being positioned in spaced relation to said first and second ends;

a third space being defined between said third finger and said first and second ends, said third space being substantially aligned with said first space for receiving said portion of said support frame;

a fourth finger projecting from one of said first and second cover portions toward the other of said first and second cover portions, said fourth finger being positioned in spaced relation to said first and second opposite ends; and a fourth space being defined between said fourth finger and said first and second opposite ends, said fourth space being substantially aligned with said second space for receiving said other portion of said support frame, said third finger and said first and second ends of said cover portions and said fourth finger and said first and second opposite ends engaging said supporting frame for positioning said cover thereon adjacent to said frangible item.

13. In combination, a cover and a sprinkler head, said sprinkler head comprising a frangible item mounted within a support frame, said cover comprising:

a pair of interengageable cover portions positionable on opposite sides of said frangible item, each of said cover portions comprising:

a first end having a latch extending therefrom;

a second end having a slot therein;

a first finger positioned in spaced relation to one of said first and said second ends and extending in substantially the same direction as said latch; and said cover portions being positionable in engagement one with another by aligning said cover portions and inserting said latches on each one of said cover portions into said slots on each other of said cover portions, a first and a second space being defined between said first fingers and said first and second ends of said cover portions upon said engagement, each said space for receiving a respective portion of said support frame, said first fingers and said ends of said cover portions engaging said portions of said support frame for positioning said cover thereon adjacent to said frangible item.

14. The combination according to claim 13, wherein each said cover portion comprises an arcuate surface having a convex side facing away from said first finger.

15. The combination according to claim 13, wherein said first fingers are positioned in spaced relation to said second end on each of said cover portions.

16. The combination according to claim 13, wherein each of said cover portions further comprises a second finger positioned in spaced relation to one of said first and said second ends and extending in substantially the same direction as said latch, a third and a fourth space being defined between said second fingers and said first and second ends of said cover portions upon said engagement, said third and fourth spaces being substantially aligned respectively with said first and second spaces for receiving said respective portions of said support frame, said second fingers and said ends of said cover portions engaging said portions of said support frame for positioning said cover thereon adjacent to said frangible item.

17. The combination according to claim 16, wherein said first and said second fingers are positioned in spaced relation to said second end on each of said cover portions.

18. In combination, a cover and a sprinkler head, said sprinkler head comprising a frangible item mounted within a support frame, said cover comprising:

a first cover portion positionable adjacent to said frangible item, said first cover portion having a first end and a first opposite end;

a second cover portion positionable adjacent to said frangible item opposite to said first cover portion, said second cover portion having a second end and a second opposite end, said first cover portion comprising an arcuate surface having a convex side facing away from said second cover portion;

a hinge positioned between and attaching said first and said second ends together, said first and said second cover portions being pivotable relatively to one another about said hinge;

a fastener extending between said first and said second opposite ends, said fastener releasably attaching said first and said second opposite ends together;

a first finger projecting from said first cover portion toward said second cover portion and positioned in spaced relation to said first and second ends;

a second finger projecting from one of said first and second cover portions toward the other of said first and second cover portions, and positioned in spaced relation to said first and said second opposite ends;

a first space being defined between said first finger and said first and second ends for receiving a first portion of said support frame; and a second space being defined between said second finger and said first and second opposite ends for receiving a second portion of said support frame, said first finger and said first and second ends engaging said first portion of said support frame, said second finger and said first and second opposite ends engaging said second portion of said support frame for positioning said cover thereon adjacent to said frangible item.

19. The combination according to claim 18, wherein said fastener comprises:

a latch extending from said first opposite end toward said second opposite end; and a slot positioned within said second opposite end, said latch being engageable within said slot to releasably attach said first and second opposite ends together.

20. The combination according to claim 18, wherein said second cover portion comprises an arcuate surface having a convex side facing away from said first cover portion.

21. The combination according to claim 18, further comprising:

a third finger projecting from said first cover portion toward said second cover portion and positioned in spaced relation to said first and second ends;

a fourth finger projecting from one of said first and second cover portions toward the other of said first and second cover portions, and positioned in spaced relation to said first and said second opposite ends;

a third space being defined between said third finger and said first and second ends for receiving said first portion of said support frame; and a fourth space being defined between said fourth finger and said first and second opposite ends for receiving said second portion of said support frame, said third finger and said first and second ends engaging said first portion of said support frame, said fourth finger and said first and second opposite ends engaging said second portion of said support frame for positioning said cover thereon adjacent to said frangible item.

22. The combination according to claim 21, wherein said third and fourth spaces are substantially aligned with said first and second spaces respectively.

23. In combination, a cover and a sprinkler head, said sprinkler head comprising a frangible item mounted within a support frame, said cover comprising:

a first cover portion;

a second cover portion, each of said cover portions having an arcuate surface;

a hinge connecting said cover portions to one another, said cover portions being pivotable about said hinge between a closed configuration wherein said cover portions are substantially adjacent to one another, and an open configuration wherein said cover portions are pivoted in spaced relation angularly apart from one another;

a first finger projecting from said first cover portion, said first finger being positioned adjacent to said hinge so as to define a first space between said finger and said hinge for receiving said frame therebetween; and a second finger projecting from one of said cover portions, said second finger being positioned in spaced relation to said first finger so as to define a second space between said fingers for receiving said frangible item, said cover portions being positionable adjacent to and on opposite sides of said frame and said frangible item when in said closed configuration.

24. The combination according to 23, wherein said second finger extends from said first cover portion.

25. The combination according to claim 23, wherein said hinge comprises a living hinge.

26. The combination according to claim 23, further comprising a fastener extending between said first and second cover portions for releasably attaching said cover portions to one another.

27. The combination according to claim 26, wherein said fastener comprises a projection mounted on one of said cover portions, and an opening mounted on the other of said cover portions, said opening being sized and positioned to receive said projection when said cover portions are in said closed configuration, said projection engaging said opening and releasably holding said cover portions in said closed configuration.

* * * * *